US011229290B1

(12) United States Patent
Bryant

(10) Patent No.: US 11,229,290 B1
(45) Date of Patent: Jan. 25, 2022

(54) PEDESTAL GLIDER AND RECLINER CHAIR AND MECHANISM

(71) Applicant: L&P PROPERTY MANAGEMENT COMPANY, South Gate, CA (US)

(72) Inventor: Jason Allan Bryant, Mooreville, MS (US)

(73) Assignee: LEGGETT & PLATT, INC., South Gate, CA (US)

( * ) Notice: Subject to any disclaimer, the term of this patent is extended or adjusted under 35 U.S.C. 154(b) by 0 days.

(21) Appl. No.: 16/932,965

(22) Filed: Jul. 20, 2020

(51) Int. Cl.

| | |
|---|---|
| ***A47C 1/034*** | (2006.01) |
| ***A47C 1/035*** | (2006.01) |
| ***A47C 1/024*** | (2006.01) |
| ***A47C 1/032*** | (2006.01) |
| ***A47C 7/00*** | (2006.01) |
| ***A47C 1/0355*** | (2013.01) |

(52) U.S. Cl.
CPC ..... *A47C 1/0242* (2013.01); *A47C 1/0355* (2013.01); *A47C 1/03294* (2013.01); *A47C 7/004* (2013.01)

(58) Field of Classification Search
CPC . A47C 1/0242; A47C 1/03294; A47C 1/0355; A47C 7/004
USPC ..... 297/83–85 M
See application file for complete search history.

(56) References Cited

U.S. PATENT DOCUMENTS

| | | | | | |
|---|---|---|---|---|---|
| 4,544,201 | A * | 10/1985 | Rogers, Jr. | A47C 1/0355 | 297/84 X |
| 5,186,518 | A * | 2/1993 | Pine | A47C 1/0355 | 297/85 L |
| 5,651,580 | A * | 7/1997 | LaPointe | A47C 1/0355 | 297/85 M |
| 5,704,686 | A * | 1/1998 | May | A47C 1/0355 | 297/85 L X |
| 5,992,931 | A * | 11/1999 | LaPointe | A47C 1/0345 | 297/85 M |
| 6,142,558 | A * | 11/2000 | May | A47C 1/0355 | 297/85 R X |
| 8,366,188 | B2 * | 2/2013 | Adams | A47C 1/0355 | 297/85 R |
| 8,398,165 | B2 * | 3/2013 | Lawson | A47C 1/0355 | 297/85 M |
| 8,398,169 | B2 * | 3/2013 | LaPointe | A47C 1/0355 | 297/85 M X |

(Continued)

*Primary Examiner* — Rodney B White
(74) *Attorney, Agent, or Firm* — Shook Hardy & Bacon, LLP

(57) ABSTRACT

A seating unit is provided with a glider linkage and a powered reclining mechanism, supported on a pedestal base. The glider linkage allows the seating unit to move to and fro in a gliding motion when the seating unit is in the closed position. The powered reclining mechanism allows independent operation of the footrest and back recline, utilizing a two-motor design. As the seating unit moves from the closed position to the TV position, with the footrest extended, a locking linkage prevents the glider linkage from moving. Additionally, the locking of the glider linkage provides at least a portion of the change in pitch of the seat. The recliner linkage provides the remaining portion of the change in pitch of the seat as the mechanism moves from the closed to the TV position. Because the back recline is independent from the footrest extension, the back can be at least partially reclined even when the seating unit is in the closed position.

17 Claims, 8 Drawing Sheets

(56) References Cited

U.S. PATENT DOCUMENTS

| | | | | |
|---|---|---|---|---|
| 8,517,463 | B2 * | 8/2013 | Murphy | A47C 1/0355 297/84 |
| 8,616,627 | B2 * | 12/2013 | Murphy | A47C 1/0355 297/85 L |
| 8,833,844 | B2 * | 9/2014 | LaPointe | A47C 1/0355 297/85 M |
| 9,089,218 | B2 * | 7/2015 | Pelletier | A47C 1/0355 |
| 9,149,121 | B2 * | 10/2015 | Hoffman | A47C 1/035 |
| 9,357,847 | B2 * | 6/2016 | Murphy | A47C 1/034 |
| 9,603,452 | B2 * | 3/2017 | Murphy | A47C 1/03294 |
| 10,653,243 | B2 * | 5/2020 | Lawson | A47C 1/0355 |
| 2010/0127555 | A1 * | 5/2010 | Hoffman | A47C 3/0255 297/85 M |
| 2010/0127556 | A1 * | 5/2010 | Hoffman | A47C 3/0255 297/85 R |
| 2011/0018331 | A1 * | 1/2011 | Murphy | A47C 1/0355 297/85 R |
| 2011/0175426 | A1 * | 7/2011 | Lawson | A47C 1/0355 297/85 M |
| 2018/0027967 | A1 * | 2/2018 | Lawson | A47C 1/0352 |
| 2020/0275781 | A1 * | 9/2020 | Lawson | A47C 1/03211 |

* cited by examiner

FIG. 1.
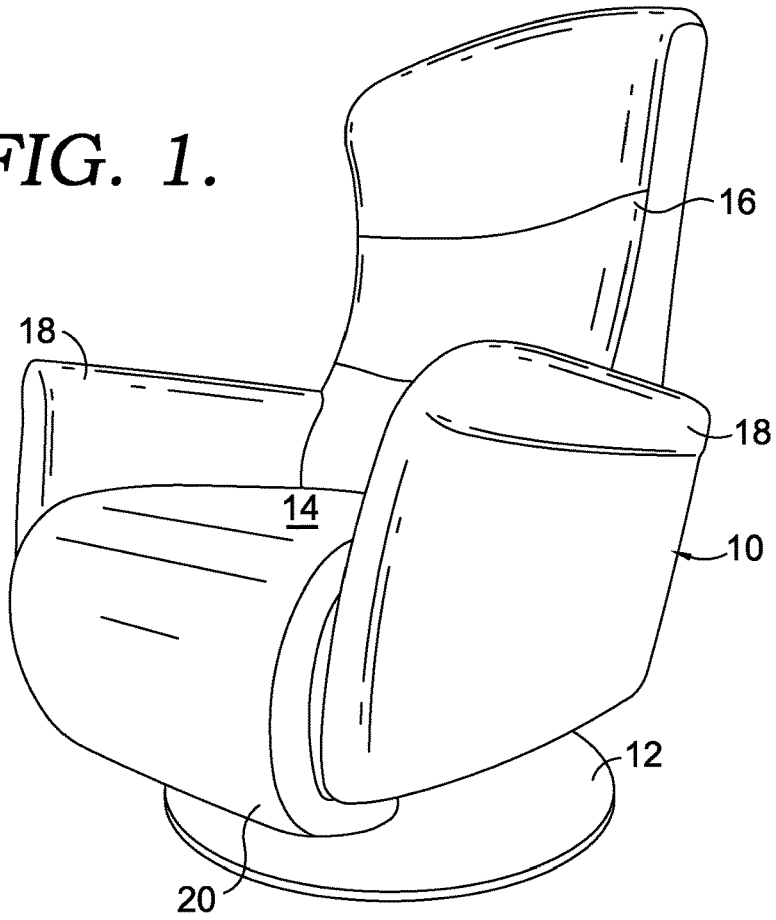
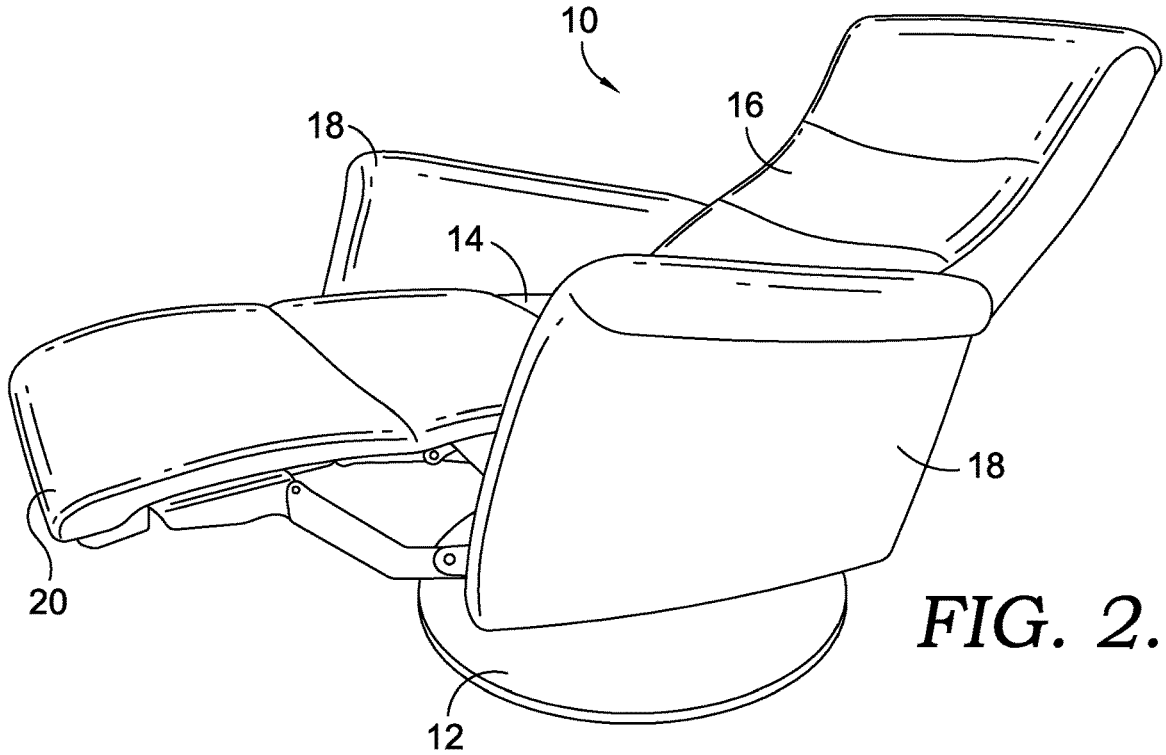
FIG. 2.

PEDESTAL GLIDER AND RECLINER CHAIR AND MECHANISM

BACKGROUND

The present invention relates broadly to motion furniture and motion furniture mechanisms. More particularly, the present invention relates to a glider and reclining mechanism for use on a chair, supported by a pedestal, and a chair incorporating such a mechanism.

Mechanisms for seating units known as gliders and recliners are available. But, in these seating units, the mechanism of the chair is typically a square steel base. The sides or arms of these seating units hide this base, but the overall appearance of the chair is quite substantial and not appealing to all consumers. Additionally, the mechanisms on these known gliders typically extend the footrest and recline the back in a coordinated fashion. If these seating units are motorized, typically one motor is used to extend the footrest and recline the back.

It would be advantageous to be able to offer consumers a glider seating unit with arms supported above the floor to provide a more modern, sleek appearance. In moving from a closed position to a TV position (with the back substantially upright and the footrest extended), it would be advantageous to achieve some level of seat pitch change, such that the seat tilts downwardly from front to back. This position has been found to be more comfortable for a majority of users. Additionally, it would be advantageous to provide a powered mechanism in which the footrest and the back recline can be independently operated.

BRIEF SUMMARY OF THE INVENTION

Accordingly, one aspect of the present invention seeks to provide a seating unit with a glider linkage and a powered reclining mechanism, supported on a pedestal base. At a high level, the glider linkage allows the seating unit to move to and fro in a gliding motion when the seating unit is in the closed position. The powered reclining mechanism allows independent operation of the footrest and back recline, utilizing a two-motor design. As the seating unit moves from the closed position to the TV position, with the footrest extended, a locking linkage prevents the glider linkage from moving. Additionally, the locking of the glider linkage provides at least a portion of the change in pitch of the seat. The recliner linkage provides the remaining portion of the change in pitch of the seat as the mechanism moves from the closed to the TV position. Because the back recline is independent from the footrest extension, the back can be at least partially reclined even when the seating unit is in the closed position. The pedestal design offers a stable base, but also one which offers a distinctive, desirable appearance.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views:

FIG. 1 is a perspective view of a pedestal glider in a closed position, in accordance with aspects hereof;

FIG. 2 is a perspective view of the pedestal glider of FIG. 1, in the reclined position, in accordance with aspects hereof;

DETAILED DESCRIPTION OF THE INVENTION

Figure 3:
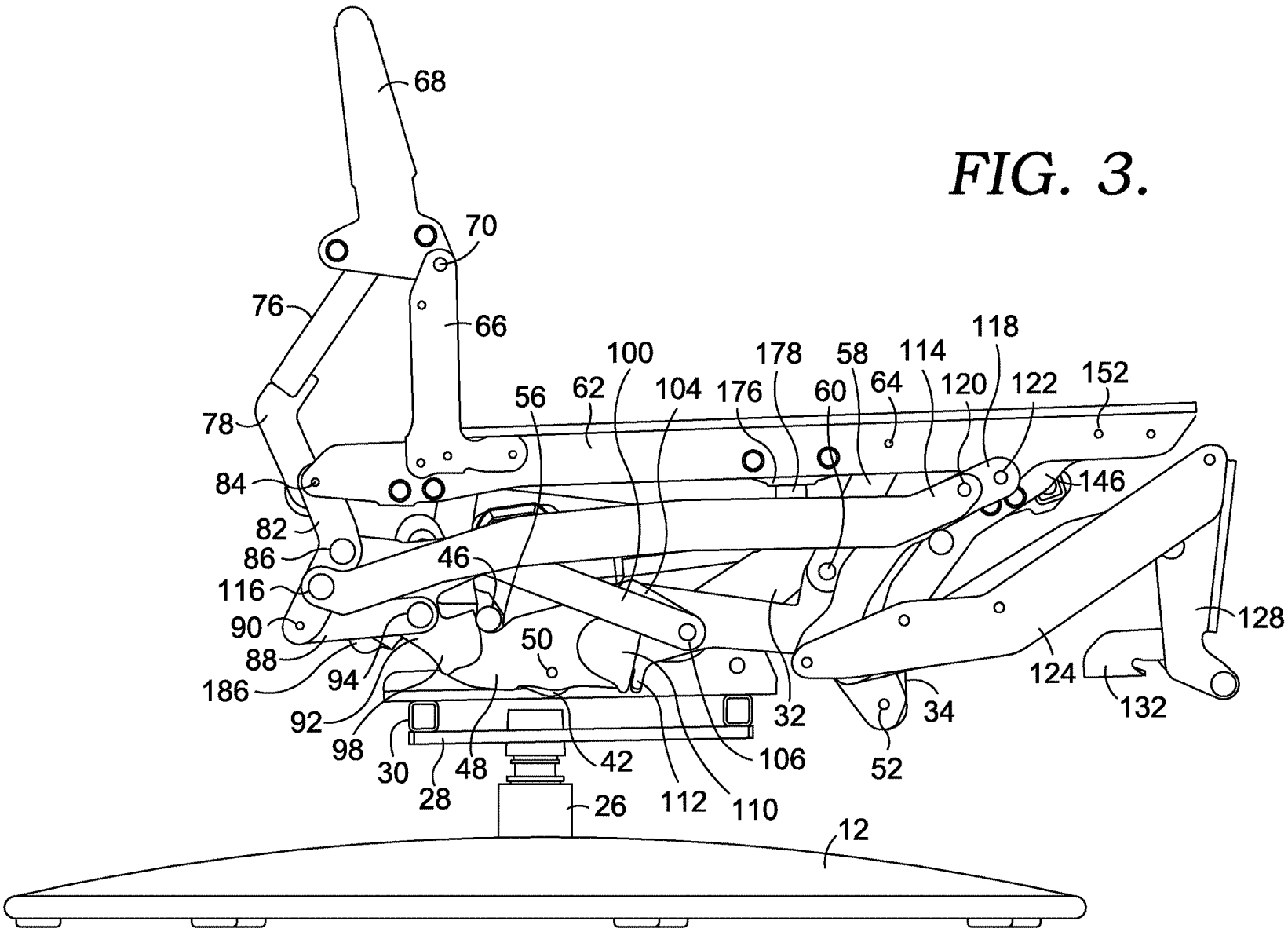
FIG. 3 is a side view of a mechanism used in the pedestal glider of FIG. 1 shown in the forward glide position, in accordance with aspects hereof.

The subject matter of aspects of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical. For example, the terms "vertical" and "vertically" as used herein refer to a direction perpendicular to each of the lateral and longitudinal axes. As a further example, the longitudinal axis may extend in a front-to-back direction of a seating unit and the lateral axis may extend in a side-to-side direction of the seating unit. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

FIG. 1 illustrates a gliding, reclining seating unit 10. The seating unit 10 has a circular base 12 that supports a seat 14, back 16, arms 18 and footrest 20. The seating unit 10 includes a glide linkage 22 (see FIG. 8) that allows the seating unit to move to-and-fro in a gliding motion when the seating unit 10 is in the closed position, with the footrest 20 stowed in a generally vertical position. The seating unit 10 also includes a recliner linkage 24 that allows the seating unit 10 to move from the closed position to a TV position with the footrest 20 extended and a fully reclined position with the footrest 20 extended and the back 16 reclined. The recliner linkage 24 is constructed to allow independent extension of the footrest 20 and independent recline of back 16. Even in the closed position, the back 16 can be reclined, at least partially.

Figure 6:
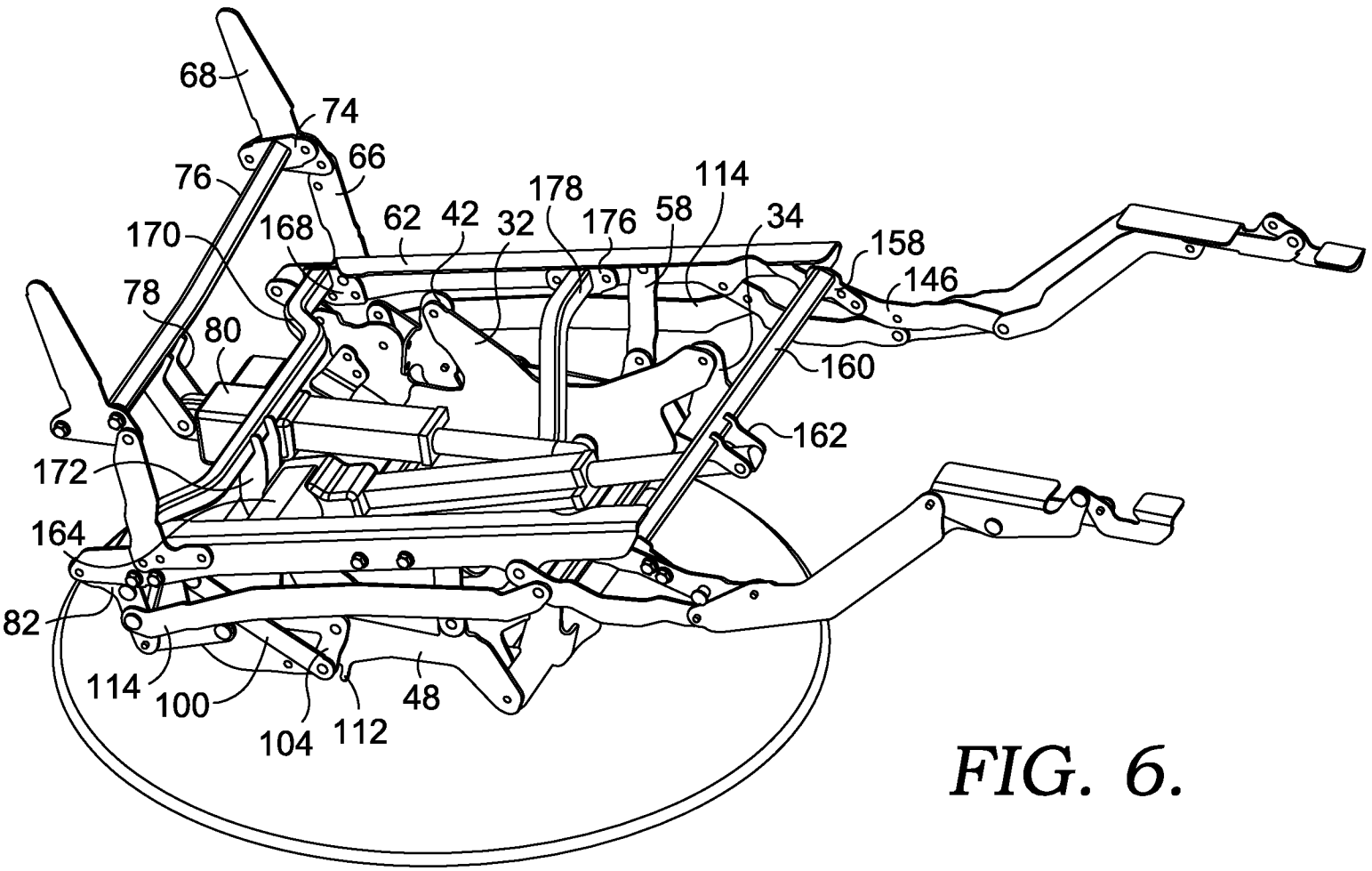
FIG. 6 is a perspective view of the mechanism of FIG. 3, shown with the ottoman extended, in accordance with aspects hereof.
Figure 7:
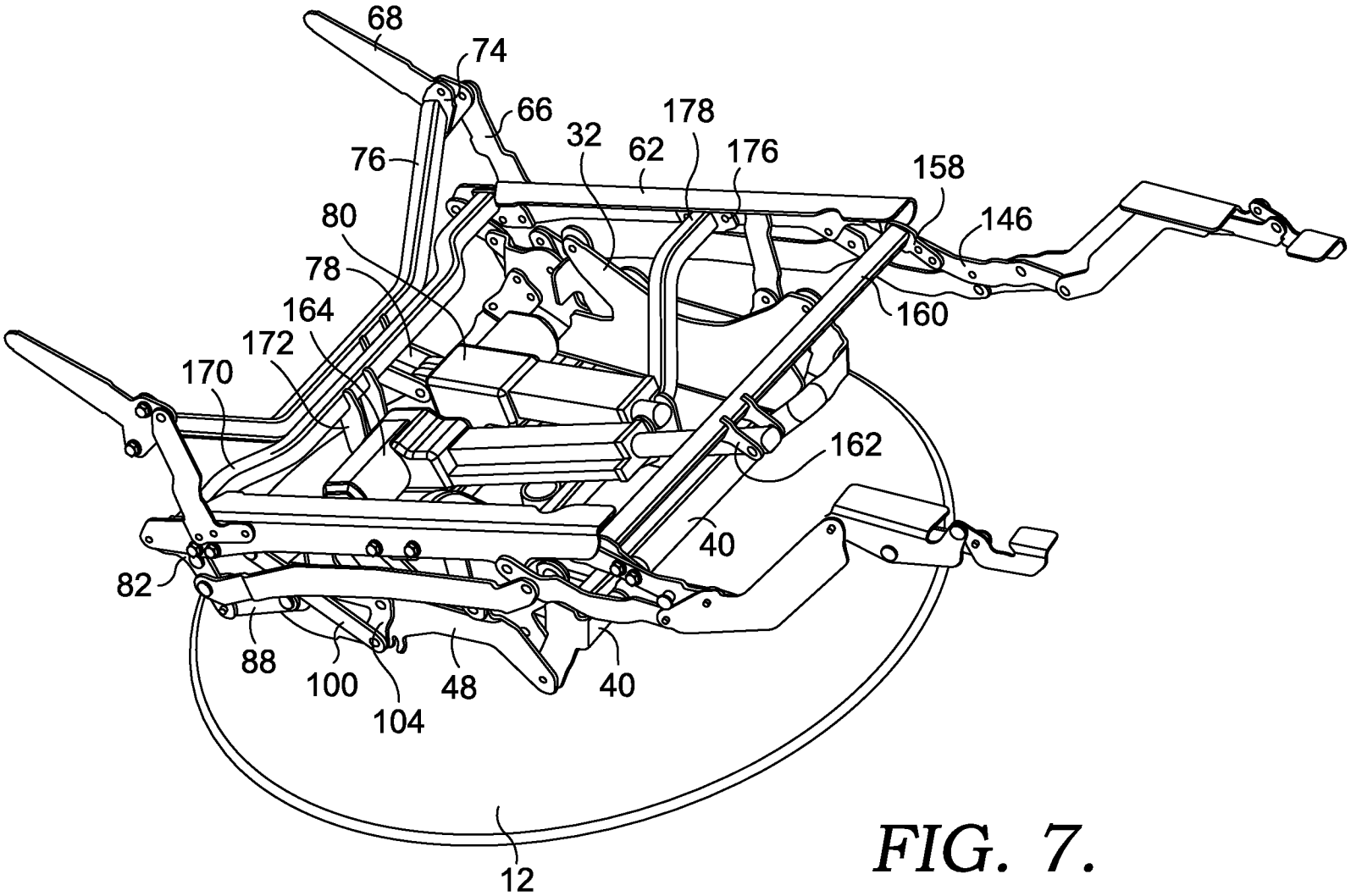
FIG. 7 is a view similar to FIG. 6, but in the fully-reclined position, in accordance with aspects hereof.
Figure 8:
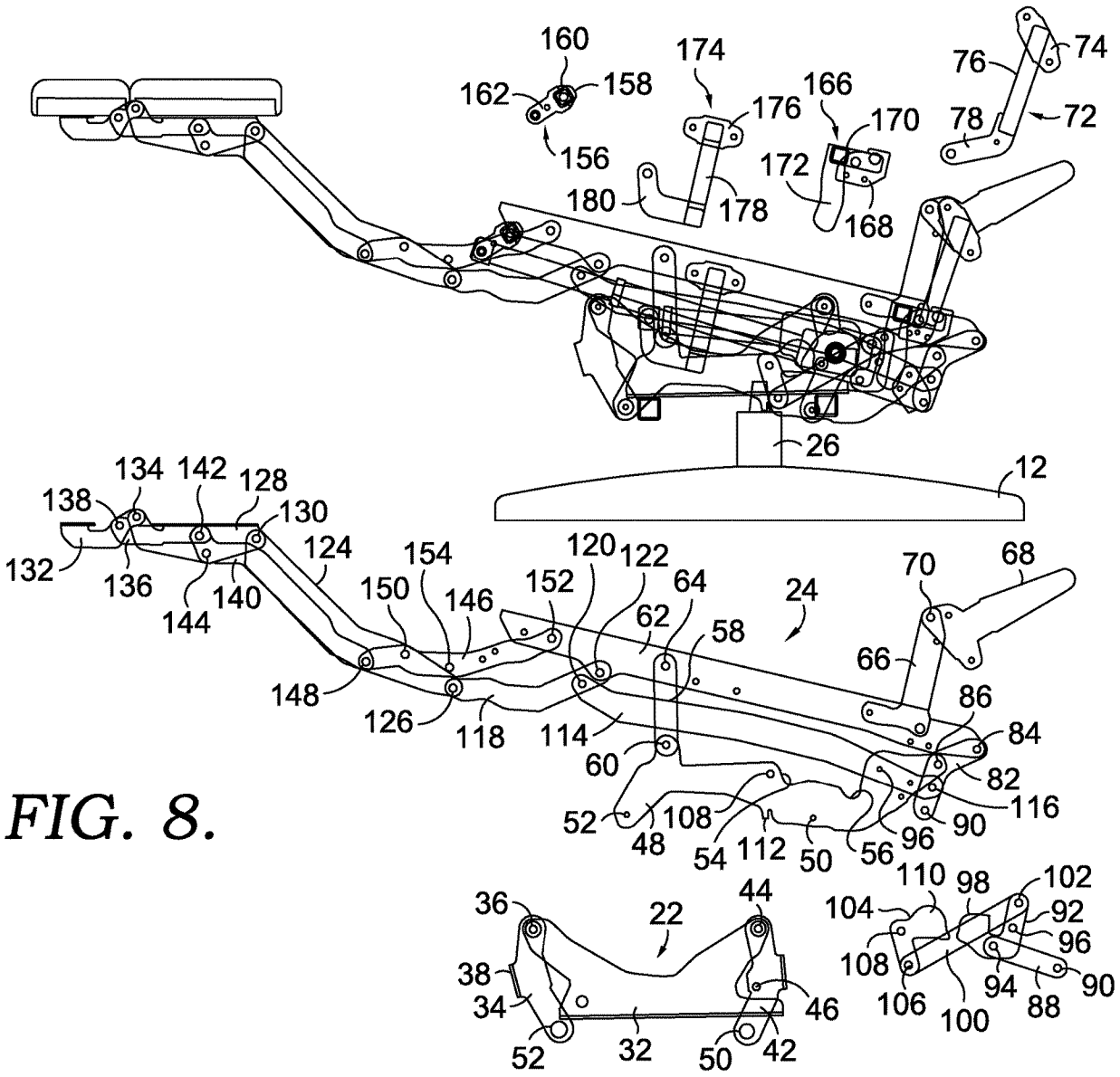
FIG. 8 is an exploded view of the mechanism of FIG. 3, showing certain component assemblies broken out to reveal details of construction.

FIGS. 3-7 show the seating unit 10 without the seat 14, back 16 and footrest 20 to reveal details of construction of the underlying glide linkage 22 and recliner linkage 24 (shown in FIG. 8). The circular base 12 (which could be square, rectangular, ovular or other shapes as well), supports a pedestal column 26. As seen in FIG. 3, the pedestal column 26 extends upwardly from base 12. The pedestal column 26, in turn, supports a base plate 28. In some aspects, the base plate 28 rotates, or swivels, about the pedestal column 26, and may be supported, for example, by a bearing to allow this swivel motion. In some aspects, the base plate 28 does not extend from one side of seating unit 10 to the other. Instead, front and rear support tubes 30 are fixedly coupled to base plate 28. Support tubes 30, in some aspects, are square steel tubing and provide a rigid support for glide linkage 22 and recliner linkage 24. The base 12, pedestal column 26 and base plate 28 support the glide linkage 22 and the recliner linkage 24 at a desired height (such that seat 14 is at the desired height from the underlying support surface). The pedestal column 26 allows the seating unit 10 to have a styling where the arms 18 are spaced from the floor, providing an option for a more modern styling, rather than traditional powered glider recliners with a metal to the floor type base.

Figure 4:
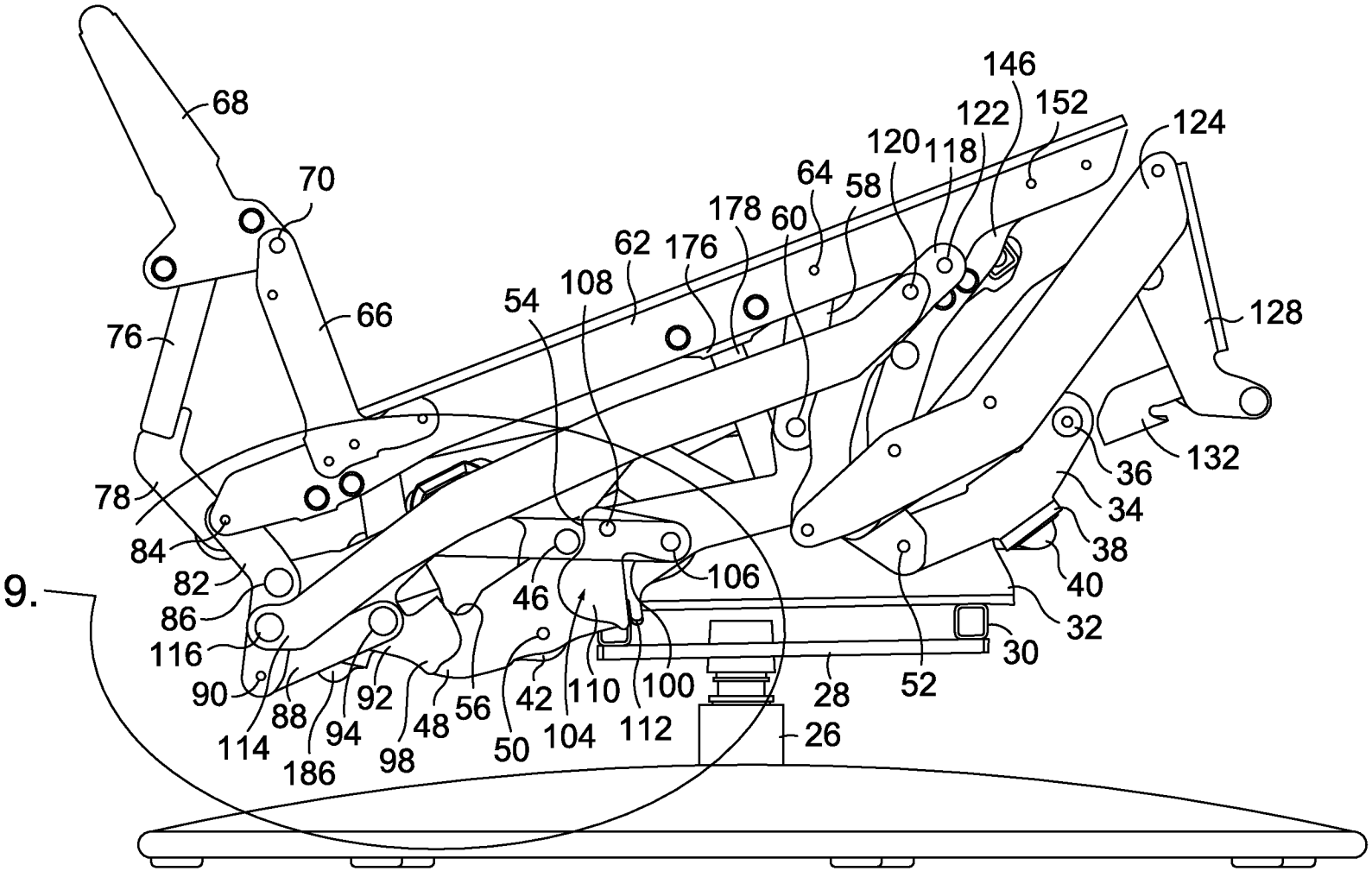
FIG. 4 is a view similar to FIG. 3, but in the rearward glide position, in accordance with aspects hereof.

As best seen in FIG. 8, glide linkage 24 includes a glide bracket 32 that is fixedly coupled to both support tubes 30, such as by welding or bolting. The glide bracket 32 is shaped as shown, and extends upwardly from support tubes 30. A front swing link 34 is pivotally coupled to the top front of glide bracket 32 at pivot point 36. In some aspects, the front swing link 34 includes an inwardly extending bracket 38. The bracket 38 is used as a coupling surface for a front support tube 40 (shown in FIG. 4). The front support tube 40 is fixedly coupled to each front swing link 34 via the bracket 38, and extends from one side to the other to provide stability and support. Similarly, a rear swing link 42 is pivotally coupled to the top rear of glide bracket 32 at pivot point 44. As best seen in FIGS. 3 and 8, rear swing link 42 includes a stop 46 that is fixedly coupled to the rear swing link 42, and extends outwardly therefrom. The lower end of rear swing link 42 is pivotally coupled to a carrier link 48, as best seen in FIGS. 3 and 8, at pivot point 50. The carrier link 48 is also pivotally coupled to the front swing link 34 at pivot point 52 (seen in FIGS. 4 and 8). The carrier link 48 carries the recliner linkage 24, and moves to-and-fro as the front swing link 34 and rear swing link 42 pivot, or "swing," on the glide bracket 32. To limit the forward and rearward glide positions, and as best seen in FIG. 8, the top of carrier link 48 has a front notch 54 and a rear notch 56 formed therein. As best seen in FIG. 4, in the rearward glide position, the stop 46 on rear swing link 42 abuts front notch 54 to prevent further rearward glide. Similarly, as best seen in FIG. 3, in the forward glide position, the stop 46 on rear swing link 42 abuts rear notch 56 to prevent further forward glide.

The top front of carrier link 48 is pivotally coupled to a front pivot link 58 at pivot point 60. The end of pivot link 58 opposite pivot point 60 is pivotally coupled to a seat plate 62 at pivot point 64. The seat plate 62 is coupled to, and supports, the seat 14. As best seen in FIGS. 7 and 8, a back mounting support bracket 66 is fixedly coupled to the seat plate 62, such as by using bolts or rivets, for example. A back mounting bracket 68 is pivotally coupled to the top of the back mounting support bracket 66 at pivot point 70. The back mounting support bracket 66 thus pivotally supports back mounting bracket 68 above seat plate 62. The back mounting bracket 68 has an upper portion configured to be coupled to the back 16, as is known to those of skill in the art. The bottom of the back mounting bracket 68 is fixedly coupled to a rear recline motor tube assembly 72 as best seen in FIG. 8. The rear recline motor tube assembly 72 extends from one side of the seating unit 10 to the other, coupling opposing back mounting brackets 68 to one another. The rear recline motor tube assembly 72, in some aspects, includes an end bracket 74 that is fixedly coupled to the back mounting bracket 68. A motor tube 76 is fixedly coupled between opposing end brackets 74, and in some aspects bends downwardly in the center section of the motor tube 76. The center section of the motor tube 76 has a clevis 78. A recline motor 80 is pivotally coupled to clevis 78. As discussed in more detail below, the recline motor 80 can be activated to pivot back mounting bracket 68 about pivot point 70 to recline the back 16 of the seating unit 10.

As best seen in FIG. 8, a rear pivot link 82 is pivotally coupled to the rear end of seat plate 62 at pivot point 84. The rear pivot link 82 has a slight bend, and near the bend the rear pivot link 82 is pivotally coupled to the carrier link 48 at pivot point 86. The end of rear pivot link 82 opposite pivot point 84 is pivotally coupled to a blocker drive link 88 at pivot point 90. The end of blocker drive link 88 opposite pivot point 90 is pivotally coupled to a rear blocker 92 at pivot point 94. The rear blocker 92 is somewhat u-shaped, with the pivot point 94 being generally near the center of the u-shape. On one arm of the u-shape, rear blocker 92 is pivotally coupled to carrier link 48 at pivot point 96. As explained in more detail below, rear blocker 92 rotates about pivot point 96, driven by blocker drive link 88. The other arm of the u-shape of rear blocker 92 has a blocker head 98. In some aspects, the blocker head 98 has a slight detent to capture one side of the stop 46 on the rear swing link 42 (when the footrest 20 is extended). A blocker control link 100 is pivotally coupled at pivot point 102 on the upper end of the arm of the u-shape of rear blocker 92 having pivot point 96. The end of blocker control link 100 opposite pivot point 102 is pivotally coupled to a front blocker 104 at pivot point 106. The blocker control link 100 thus coordinates the rotation of rear blocker 92 and front blocker 104. The front blocker 104 is somewhat v-shaped, with the outer end of one leg of the V-shape having pivot point 106. The center of the V-shape of front blocker 104 is pivotally coupled to carrier link 48 at pivot point 108. The other leg of the V-shape is a blocker head 110. Like the blocker head 98, the blocker head 110 has a slight detent to capture one side of the stop 46 on the rear swing link 42 (when the footrest 20 is extended). To prevent over-rotation of the front blocker 104, the carrier link 48, in some aspects, includes a stop tab 112, at least a portion of which extends outwardly away from the surface of the remainder of carrier link 48. As best seen in FIG. 4, when the footrest 20 is closed, a flat surface of the blocker head 110 contacts the stop tab 112 and prevents the front blocker 104 from rotating to an over-center condition.

As best seen in FIG. 4, an ottoman drive link 114 is pivotally coupled on one end to the rear pivot link 82 at pivot point 116. The ottoman drive link 114 extends forwardly and is pivotally coupled on the end opposite pivot point 116 to a rear ottoman link 118 at pivot point 120. The ottoman drive link 114 thus couples the rear pivot link 82 to the rear ottoman link 118. The rear ottoman link 118 is pivotally coupled to the seat plate 62 at pivot point 122. As best seen in FIG. 8, the opposite end of rear ottoman link 118 is pivotally coupled to an outer ottoman link 124 at pivot point 126. The outer ottoman link 124 extends away from pivot point 126 and is pivotally coupled on the opposite end to a footrest bracket 128 at pivot point 130. The footrest bracket 128 is coupled to and supports the footrest 20. In some aspects, a flipper 132 is pivotally coupled to the footrest bracket 128 at pivot point 134. The flipper 132 supports an extended part of footrest 20, and is also pivotally coupled to a flipper drive link 136 at pivot point 138. The opposite end of the flipper drive link 136 is pivotally coupled to an inner ottoman link 140 at pivot point 142. Inner ottoman link 140 extends away from pivot point 142, and is pivotally coupled to the footrest bracket 128 at pivot point 144, and is also pivotally coupled on the opposite end to a front ottoman link 146 at pivot point 148. Near pivot point 148, the front ottoman link 146 is also pivotally coupled to outer ottoman link 124 at pivot point 150. The front ottoman link 146 extends away from pivot point 150 and is pivotally coupled on the opposite end to seat plate 62 at pivot point 152. In some aspects, a stop 154 is fixedly coupled to the front ottoman link 146, and abuts a surface on outer ottoman link 124 when the footrest is extended, to prevent over extending the footrest linkage.

As best seen in FIGS. 6 and 8, a front ottoman motor tube assembly 156 is coupled between opposing front ottoman links 146. More specifically, the front ottoman motor tube assembly 156 includes a motor tube bracket 158 that is fixedly coupled to a corresponding front ottoman link 146, such as, for example, by bolts or rivets. A front motor tube 160 is coupled on each end to the corresponding motor tube bracket 158, such as by welding. Generally mid-way between the motor tube brackets, a clevis 162 is coupled to the front motor tube 160. The clevis 162 is used to pivotally couple the shaft of a motor 164 to the front motor tube 160. As best seen in FIGS. 6 and 8, a rear ottoman motor tube assembly 166 is fixedly coupled between corresponding seat plates 62. More specifically, the rear ottoman motor tube assembly 166 includes a motor tube bracket 168 that is fixedly coupled to a corresponding seat plate 62, such as, for example, by bolts or rivets. A rear motor tube 170 is coupled on each end to the corresponding motor tube bracket 168, such as by welding. In some aspects, the rear motor tube 170 includes a forward bend section that extends forward from the position of the motor tube brackets 168. This forward bend section provides clearance for a second motor, as described in detail below. Generally mid-way between the motor tube brackets 168, a clevis 172 is coupled to the rear motor tube 170. The clevis 172 is used to pivotally couple the motor 164 to the rear motor tube 170.

As best seen in FIG. 8, a front recline motor tube assembly 174 is coupled between opposing seat plates 62. More specifically, as shown in FIG. 6, the front recline motor tube assembly 174 includes a motor tube bracket 176 that is fixedly coupled to a corresponding seat plate 62, such as, for example, by bolts or rivets. A front motor tube 178 is coupled on each end to the corresponding motor tube bracket 176, such as by welding. As seen in FIG. 7, the front motor tube 178 has a downwardly extending bend section that provides clearance for motor 164. Generally mid-way between the motor tube brackets 176, a clevis 180 is coupled to the front motor tube 178. The clevis 180 is used to pivotally couple the shaft of the recline motor 80 to the front motor tube 178. In some aspects, clevis 180 extends forwardly to provide the stroke needed for motor 80, while positioning the front motor tube 178 to provide clearance for other components. In some aspects, the front motor tube 178 includes a central, downwardly extending bend to provide clearance for motor 164, and allow motor 164 and motor 80 to operate independently without interfering with one another. As described above, a rear recline motor tube assembly 72 is fixedly coupled between corresponding back mounting brackets 68. The motor 80 is pivotally coupled to the clevis 78, and the motor tube 76.

Figure 5:
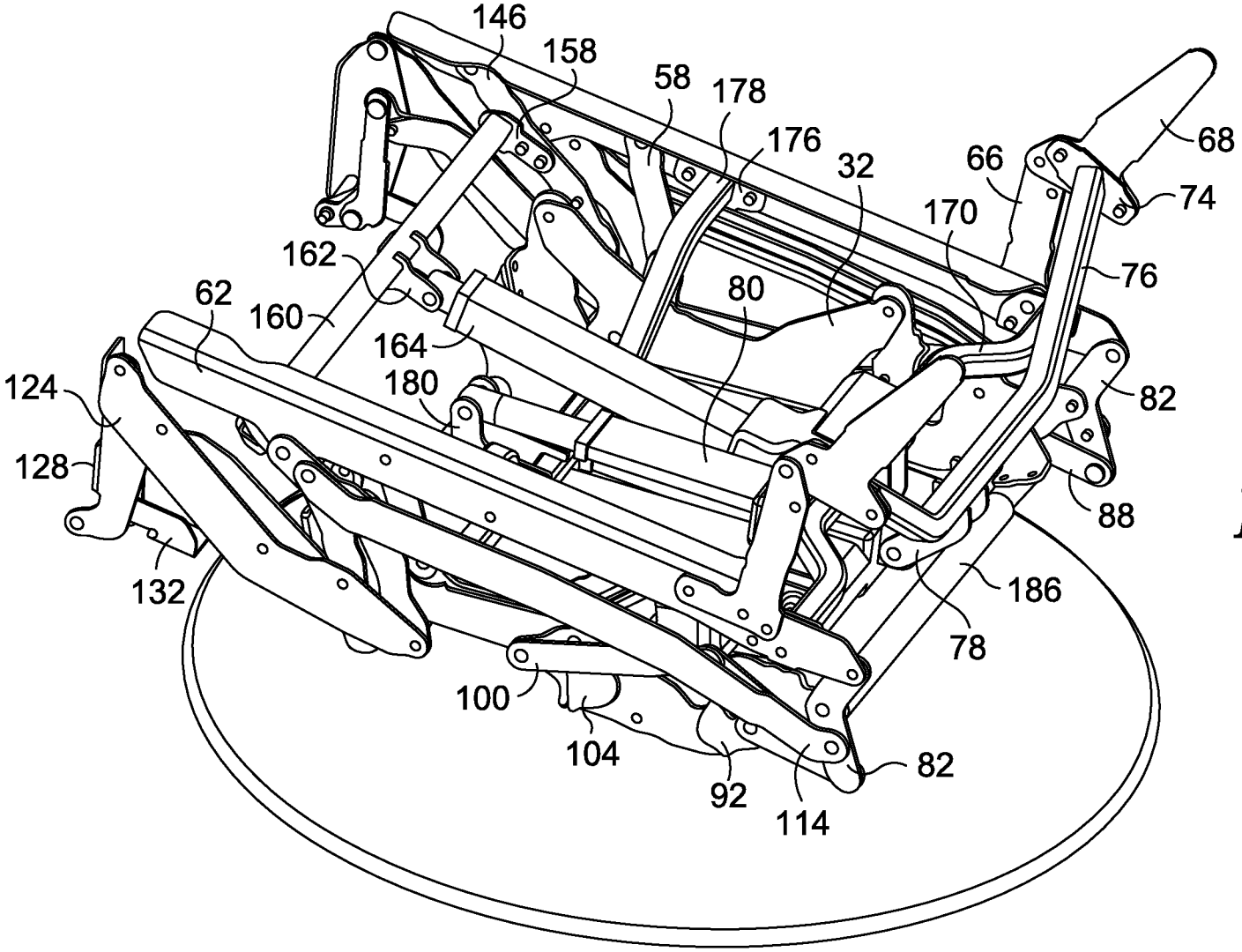
FIG. 5 is a perspective view of the mechanism of FIG. 3, in closed position, in accordance with aspects hereof.

As best seen in FIG. 5, in some aspects, additional stabilization may be provided by a support tube 186 that is fixedly coupled between corresponding carrier links 48. As would be known by those of skill in the art, any of the fixed couplings described herein may be accomplished by bolting or riveting parts together. Other fixing members or techniques could also be used, such as, for example, welding.

The motor 80 and the motor 164 are typically connected to controls allowing the user to operate the selected motor. In some aspects, the motor 80 may be activated to at least partially recline back mounting brackets 68 (and thus back 16) with the footrest 20 in a closed position, as best seen in FIG. 5. Some users find this closed position to be more comfortable than a more upright back. In some aspects, the amount of recline of back 16 may be limited when the footrest 20 is in the closed position, to prevent unstable or tipping conditions for the seating unit 10. This can be done, for example, by programming limits on motor 80 when the footrest 20 is in the closed position.

The footrest 20 can be extended by activating motor 164. As the shaft of motor 164 extends, the footrest 20 is driven open as the motor provides forward and rotational force to the front ottoman links 146. As the footrest linkage opens, rear ottoman links 118 rotate about their respective pivot points 122. The rotation pulls ottoman drive links 114 forwardly, causing the rear pivot link 82 to rotate clockwise (as viewed in FIG. 8) about pivot points 84. As the rear pivot links 82 rotate, the blocker drive links 88 are driven generally forwardly. This in turn causes the rear blockers 92 to rotate about pivot points 96. As viewed in FIG. 8, the rear blockers 92 rotate clockwise. As the rear blockers 92 rotate, the front blockers 104 follow with a counter-rotational movement about pivot points 108, due to the coupling of rear blocker 92 and front blocker 104 through blocker control link 100. As the front blocker 104 and the rear blocker 92 rotate, the corresponding blocker head 110 and blocker head 98 contact stop 46 on rear swing link 42, and prevent rear swing link 42 from further movement. This locks the rear swing link 42 and prevents the back and forth movement of the glide linkage 22 when the footrest 20 is extended. As the stop 46 and rear swing link 42 are constrained by the front blocker 104 and the rear blocker 92, the pitch or angle of the seat plate 62 is changed such that the seat pitch increases (more inclined from back to front) as the footrest 20 opens due to the position at which the glide linkage 22 is locked out (part way between the forward glide of FIG. 3 and the rearward glide of FIG. 4). The front blocker 104 cooperating with the rear blocker 92 allow a smooth transition to the locked position. More specifically, the contoured shape of the rear blocker head 98 and the front blocker head 110, as well as their positioning, captures the stop 46 smoothly, and at a desired location to achieve a smooth lock-out and a desired seat pitch change. Additionally, as the mechanism moves from the closed position to the TV position, the seat pitch is also changed as the front pivot link 58 and rear pivot link 82 pivot on carrier link. Because some seat pitch change is achieved by locking the glide linkage 22 (by locking the stop 46 of the rear swing link 42), the added seat pitch change needed by the front pivot link 58 and rear pivot link 82 is reduced. This allows a compact recliner mechanism 24 that is mounted on the single pedestal column 26, while still providing a glider linkage 24 and a seating unit 10 with arms supported off the floor for a sleek design.

The motor 80 can be activated to recline the back 16 independent of whether the footrest 20 is closed or extended. For example, the back mounting bracket 68 can be reclined using motor 80 when the footrest 20 is in the closed position. Similarly, with the footrest 20 extended, the motor 80 can be activated by the user to move the seating unit from the TV position of FIG. 6 to the fully-reclined position of FIG. 7. In the fully-reclined position of FIG. 7 the central bent section of rear motor tube 170 provides clearance for the central bent section of motor tube 76 as it moves forwardly when the motor 80 reclines the back bracket 68.

Figure 9:
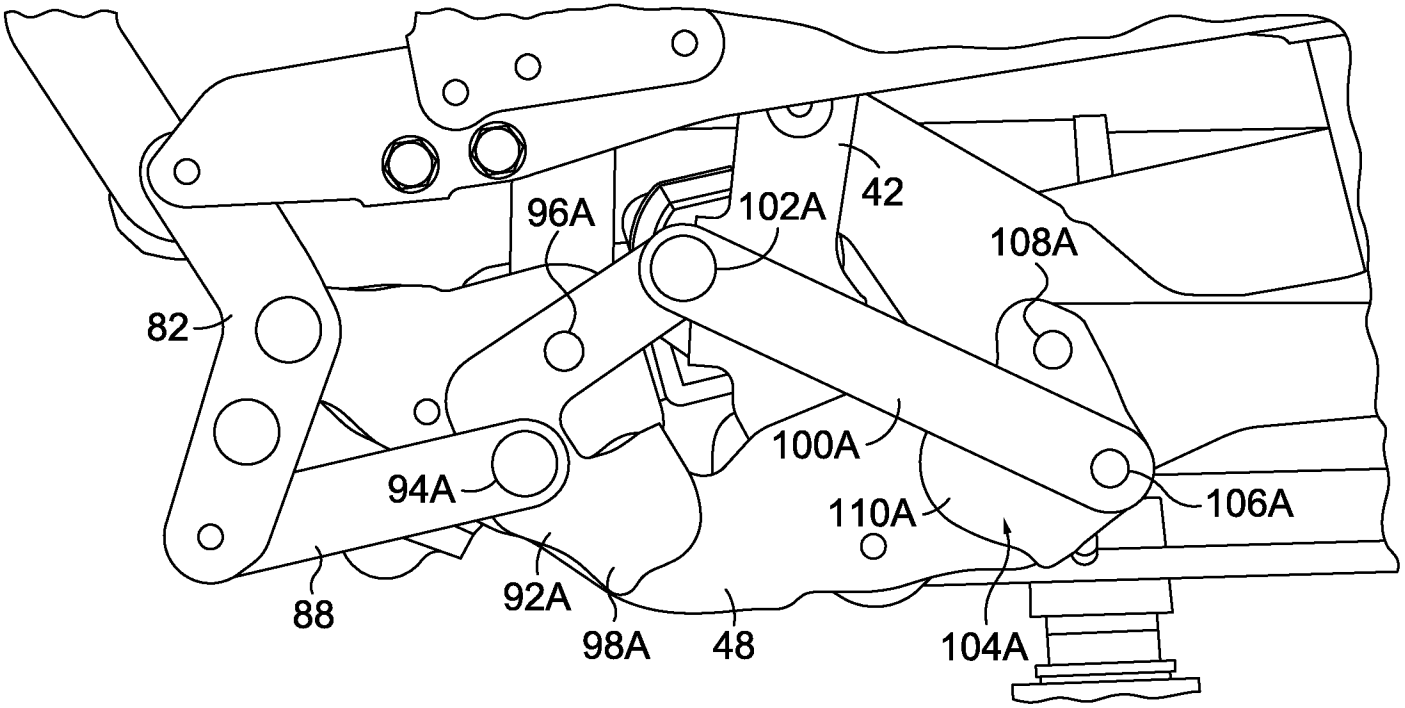
FIG. 9 is an enlarged view of selected components of an alternative aspect of a blocker linkage.

In another aspect, as seen in FIG. 9, a slightly different blocker linkage may be used. In this aspect, the changed component parts and pivot points have been labeled with the corresponding number described above, but with the suffix "A". More specifically, in this aspect, the forward end of blocker drive link 88 is pivotally coupled to a rear blocker 92A at pivot point 94A. The rear blocker 92A is somewhat u-shaped, with the pivot point 94A being generally near the center of the u-shape. On one arm of the u-shape, rear blocker 92A is pivotally coupled to carrier link 48 at pivot point 96A. The rear blocker 92A rotates about pivot point 96A, driven by blocker drive link 88. The other arm of the u-shape of rear blocker 92A has a blocker head 98A. In some aspects, the blocker head 98A has a slight detent to capture one side of the stop 46 on the rear swing link 42 (when the footrest 20 is extended). A blocker control link 100A is pivotally coupled at pivot point 102A on the upper end of the arm of the u-shape of rear blocker 92A having pivot point 96A. The end of blocker control link 100A opposite pivot point 102A is pivotally coupled to a front blocker 104A at pivot point 106A. The blocker control link 100A thus coordinates the rotation of rear blocker 92A and front blocker 104A. The front blocker 104A is also pivotally coupled to carrier link 48 at pivot point 108A. The front blocker 104A also has a blocker head 110A. Like the blocker head 98A, the blocker head 110A has a slight detent to capture one side of the stop 46 on the rear swing link 42 (when the footrest 20 is extended). With this alternative aspect, the stop tab 112 described above is not needed to prevent over-rotation of the front blocker 104A. As can be seen by comparing FIG. 4 and FIG. 9, the orientation of the blocker linkage components in FIG. 9 offers certain advantages. The center line of blocker control link 100 (bisecting pivot points 102 and 106) forms an angle with a line connecting pivot points 106 and 108 on front blocker 104. As the seating unit 10 glides rearward, this angle becomes small in the aspect described above with respect to FIGS. 3-8. Because of this orientation, it becomes difficult to rotate the front blocker 104, and may damage the components. In comparison, in the aspect of FIG. 9, the center line of blocker control link 100A (bisecting pivot points 102A and 106A) forms an angle with a line connecting pivot points 106A and 108A on front blocker 104A. In the aspect shown in FIG. 9 however, this angle is much greater, enabling the blocker linkage to operate with less required force, with less chance of component damage.

Persons familiar with the field of the invention will realize that it may be practiced by various devices which are different from the specific illustrated embodiments. Therefore, it is emphasized that the invention is not limited only to this embodiment but is embracing of a wide variety of mechanisms which fall within the spirit of the following claims.

What is claimed is:

1. A linkage mechanism for a gliding, reclining seating unit having at least a seat, a back and an ottoman, the linkage mechanism comprising:

a base;

a pedestal supported on the base and extending upwardly from the base;

a base plate supported on a column above the base;

a glide linkage supported on the base plate;

a recliner linkage supported on the glide linkage;

a first motor coupled to the recliner linkage configured to move the gliding, reclining seating unit to and from a closed position with the ottoman stowed, and a TV position with the ottoman extended; and a second motor coupled to the recliner linkage configured to move the back of the gliding, reclining seating unit between an upright position and a reclined position.

2. The linkage mechanism of claim 1, wherein the first motor and the second motor are independently operable.

3. The linkage mechanism of claim 1, wherein the glide linkage comprises:

a glide bracket coupled to the base plate;

a front swing link having a first end pivotally coupled to the glide bracket and a second end pivotally coupled to the recliner linkage;

a rear swing link having a first end pivotally coupled to the glide bracket and a second end pivotally coupled to the recliner linkage;

the front swing link and the rear swing link carry the recliner linkage and allow the recliner linkage to swing forward and rearward with respect to the base when the seating unit is in a closed position.

4. The linkage mechanism of claim 3, wherein the recliner linkage comprises:

a carrier link pivotally coupled to the second end of the front swing link and the second end of the rear swing link, the carrier link supporting a remainder of the recliner linkage and moveable forward and rearward on the glide linkage; and wherein the carrier link has a top surface with at least a front notch and a rear notch formed therein;

wherein the rear swing link includes a stop protruding therefrom and located between the first end of the rear swing link and the second end of the rear swing link; and wherein the stop on the rear swing link contacts the front notch to define a rearward-most glide position and wherein the stop on the rear swing link contacts the rear notch to define a forward-most glide position.

5. The linkage mechanism of claim 4, wherein the recliner linkage further comprises:

a seat plate;

a front pivot link pivotally coupled on a first end to the seat plate and on a second end to the carrier link; and a rear pivot link having a first end and a second end, the rear pivot link pivotally coupled on one end to the seat plate and pivotally coupled to the carrier link at a point between the first end of the rear pivot link and the second end of the rear pivot link;

wherein the seat plate is pivotally supported above the carrier link by the front pivot link and the rear pivot link; and wherein a seat pitch of the seat plate increases as the seating unit moves from the closed position to the TV position, controlled at least in part by the front pivot link and the rear pivot link.

6. The linkage mechanism of claim 5, further comprising:

a rear blocker pivotally coupled to the carrier link;

a blocker drive link pivotally coupled on a first end to the second end of the rear pivot link and on a second end to the rear blocker link a front blocker pivotally coupled to the carrier link; and a blocker control link pivotally coupled between the rear blocker and the front blocker to drive counter-rotational movement of the front blocker as the rear blocker rotates;

wherein the rear blocker and the front blocker are rotated as the seating unit moves from the closed position to the TV position into a position capturing the stop on the rear swing link to prevent the rear swing link from further movement.

7. The linkage mechanism of claim 6, wherein the seat pitch increases as the seating unit moves to a rearward glide position and wherein the stop on the rear swing link is captured by the front blocker and the rear blocker in the TV position when the seating unit is at least partially in a rearward glide position, such that the seat pitch increases from the closed position to the position when the stop on the rear swing link is captured by the front blocker and the rear blocker.

8. The linkage mechanism of claim 7, wherein the carrier link has a stop tab projecting downwardly and outwardly therefrom, the stop tab contacting the front blocker when the seating unit is in a closed position, preventing the front blocker from rotating beyond the stop tab.

9. A gliding, reclining seating unit having at least a seat, a back and an ottoman, the gliding, reclining seating unit comprising:

a base;

a pedestal supported on the base and extending upwardly from the base;

a base plate supported on a column above the base;

a glide linkage supported on the base plate;

a recliner linkage supported on the glide linkage to allow the recliner linkage to move forwardly and rearwardly with respect to the glide linkage;

at least a first motor coupled to the recliner linkage configured to move the gliding, reclining seating unit to and from a closed position with the ottoman stowed, and a TV position with the ottoman extended; and a second motor coupled to the recliner linkage configured to move the back of the seating unit between an upright position and a reclined position.

10. The seating unit of claim 9, wherein the first motor and the second motor are independently operable.

11. The seating unit of claim 10, further comprising:

a glide bracket coupled to the base plate;

a front swing link having a first end pivotally coupled to the glide bracket and a second end pivotally coupled to the recliner linkage;

a rear swing link having a first end pivotally coupled to the glide bracket and a second end pivotally coupled to the recliner linkage;

wherein the front swing link and the rear swing link carry the recliner linkage and allow the recliner linkage to swing forward and rearward with respect to the glide bracket when the seating unit is in a closed position.

12. The seating unit of claim 11, further comprising:

a carrier link pivotally coupled to the second end of the front swing link and the second end of the rear swing link, the carrier link supporting a remainder of the recliner linkage and moveable forward and rearward on the glide linkage; and wherein the carrier link has a top surface with at least a front notch and a rear notch formed therein;

wherein the rear swing link includes a stop protruding therefrom and located between the first end of the rear swing link and the second end of the rear swing link; and wherein the stop on the rear swing link contacts the front notch to define a rearward-most glide position and wherein the stop on the rear swing link contacts the rear notch to define a forward-most glide position.

13. The seating unit of claim 12, further comprising:

a seat plate;

a front pivot link pivotally coupled on a first end to the seat plate and on a second end to the carrier link; and a rear pivot link having a first end and a second end, the rear pivot link pivotally coupled on one end to the seat plate and pivotally coupled to the carrier link at a point between the first end of the rear pivot link and the second end of the rear pivot link;

wherein the seat plate is pivotally supported above the carrier link by the front pivot link and the rear pivot link; and wherein a seat pitch of the seat plate increases as the seating unit moves from the closed position to the TV position, controlled at least in part by the front pivot link and the rear pivot link.

14. The seating unit of claim 13, further comprising:

a rear blocker pivotally coupled to the carrier link;

a blocker drive link pivotally coupled on a first end to the second end of the rear pivot link and on a second end to the rear blocker link a front blocker pivotally coupled to the carrier link; and a blocker control link pivotally coupled between the rear blocker and the front blocker to drive counter-rotational movement of the front blocker as the rear blocker rotates;

wherein the rear blocker and the front blocker are rotated as the seating unit moves from the closed position to the TV position into a position capturing the stop on the rear swing link to prevent the rear swing link from further movement.

15. The seating unit of claim 14, wherein the seat pitch increases as the seating unit moves to a rearward glide position and wherein the stop on the rear swing link is captured by the front blocker and the rear blocker in the TV position when the seating unit is at least partially in a rearward glide position, such that the seat pitch increases from the closed position to the position when the stop on the rear swing link is captured by the front blocker and the rear blocker.

16. A gliding reclining seating unit having at least a seat, a back and an ottoman, the gliding reclining seating unit comprising:

a base;

a pedestal column supported on the base and extending upwardly from the base;

a glide linkage supported by the pedestal column;

a recliner linkage pivotally supported on the glide linkage to allow the recliner linkage to move forwardly and rearwardly with respect to the glide linkage; and a first motor coupled to the recliner linkage to move the gliding, reclining seating unit to and from a closed position with the ottoman stowed, and a TV position with the ottoman extended; and a second motor coupled to the recliner linkage configured to move the back of the gliding, reclining seating unit between an upright position and a reclined position.

17. The seating unit of claim 16, wherein the first motor and the second motor are independently operable.

* * * * *